US007445052B2

(12) United States Patent
Jerg

(10) Patent No.: US 7,445,052 B2
(45) Date of Patent: Nov. 4, 2008

(54) FIRE PROTECTION AND FIRE EXTINGUISHING DEVICE FOR DOMESTIC APPLIANCES

(75) Inventor: Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/740,104

(22) Filed: Dec. 18, 2003

(65) Prior Publication Data

US 2004/0256119 A1 Dec. 23, 2004

Related U.S. Application Data

(63) Continuation of application No. PCT/EP02/06471, filed on Jun. 12, 2002.

(30) Foreign Application Priority Data

Jun. 26, 2001 (DE) ..... 101 30 605

(51) Int. Cl.
*A62C 37/10* (2006.01)
*A62C 3/00* (2006.01)

(52) U.S. Cl. ..... 169/60; 169/61; 169/54; 169/65; 169/56

(58) Field of Classification Search ..... 169/56, 169/60, 61, 37, 54; 34/89, 90, 544
See application file for complete search history.

(56) References Cited

U.S. PATENT DOCUMENTS

| | | | | | |
|---|---|---|---|---|---|
| 3,679,867 | A * | 7/1972 | Canter | 392/403 |
| 3,866,687 | A * | 2/1975 | Banner | 169/61 |
| 3,990,518 | A * | 11/1976 | Hemme | 169/60 |
| 4,830,116 | A * | 5/1989 | Walden et al. | 169/65 |
| 4,969,335 | A * | 11/1990 | Sasaki et al. | 62/196.4 |
| 5,694,785 | A * | 12/1997 | Balentine | 62/275 |
| 5,936,531 | A * | 8/1999 | Powers | 340/628 |
| 6,104,301 | A * | 8/2000 | Golden | 340/628 |
| 6,648,077 | B2 * | 11/2003 | Hoffman | 169/56 |
| 6,655,047 | B2 * | 12/2003 | Miller, II | 34/544 |

FOREIGN PATENT DOCUMENTS

| | | | |
|---|---|---|---|
| DE | 29901776 | U1 | 4/1999 |
| GB | 2205037 | A | 11/1988 |
| JP | 10314491 | A | 12/1998 |
| JP | 11216294 | A | 8/1999 |

* cited by examiner

*Primary Examiner*—Len Tran
*Assistant Examiner*—James S Hogan
(74) *Attorney, Agent, or Firm*—Russell W. Warnock; James E. Howard

(57) ABSTRACT

A fire protection and fire extinguishing device for a water-based domestic appliance containing at least one gas sensor and at least one water spraying system. The gas sensor generates a signal to disconnect the electrical supply of the domestic appliance while activating the at least one water spraying system when a predetermined amount of gas is sensed.

4 Claims, 1 Drawing Sheet

FIRE PROTECTION AND FIRE EXTINGUISHING DEVICE FOR DOMESTIC APPLIANCES

Figure 1:
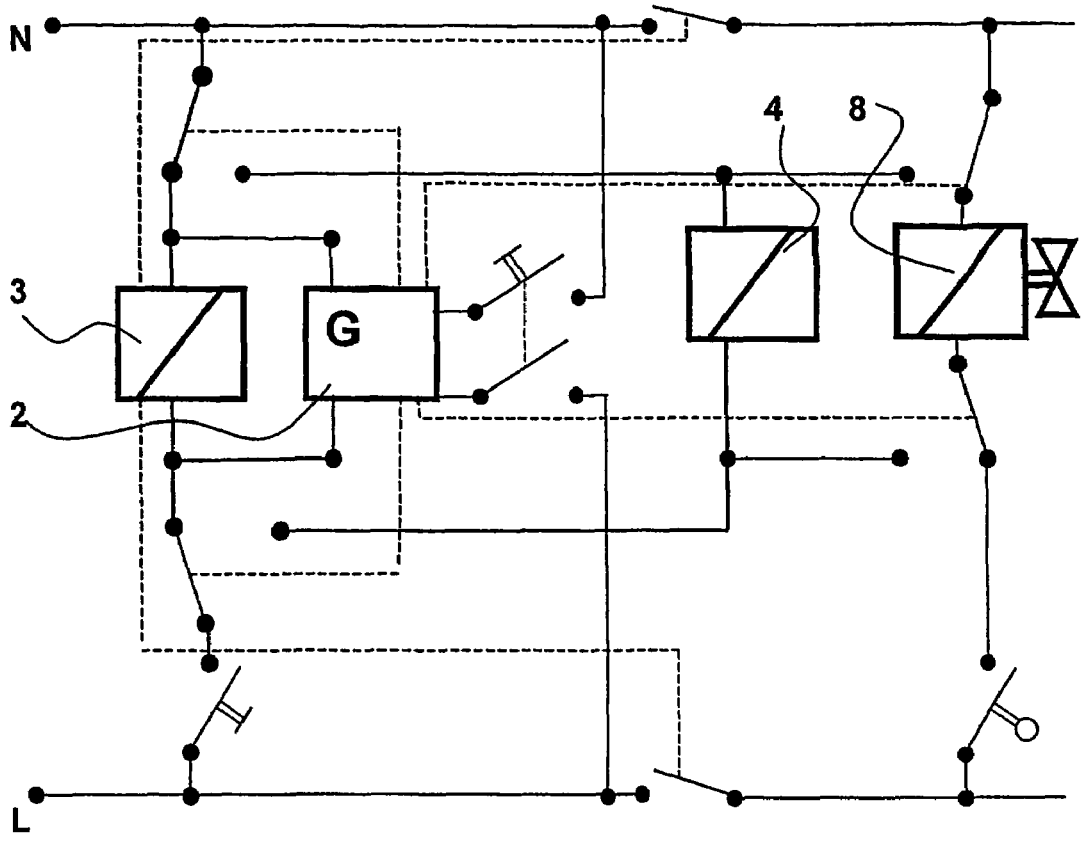

The present invention relates to a fire protection and fire extinguishing device for aquiferous domestic appliances.

Domestic appliances, which have several power consumers, such as for example motors, heaters etc., are usually not subjected to individual checks on their electrical safety. In order to avoid damage to the domestic appliances, as a result of excess current, domestic appliances generally have safety devices, which have for example a safety button made of porcelain or ceramic, which glows when a specific current strength is reached and thus protects the domestic appliance from further damage, in particular smouldering fires or the like.

Because ignitable and inflammable materials are used in the manufacture of electrical appliances for the household, there may be a heightened risk that these materials catch fire in the event of a short circuit or when electric wires wear through. DE 38 09 754 A1 discloses a device with a container for a fire retardant substance for extinguishing such fires, which container opens automatically in the presence of a flame or when the ambient temperature rises above a limit parameter, for the purpose of pouring the fire retardant substance indirectly or directly onto the parts of the appliance endangered by fire or which are to be protected therefrom. In this case an arrangement can be made where the containers, preferably several of them, in each case have cells containing fire retardant substance and which effectively have boreholes in the floor region, which are occluded by a protective film or a membranous skin, for example, which bursts at a preset temperature to open up the boreholes and in the process let the fire retardant substance escape.

It has proven advantageous with this device that the bores open only at a specific temperature, that is, when certain temperatures are reached which melt the membrane covering the bores. For this melting procedure, however, it is necessary for a sufficiently high temperature to be transferred via air, so that a very much higher temperature must already prevail on the Brandherd and as a result only then does the extinguishing commence, by which time a certain degree of destruction has already occurred.

Also, compared to the destruction of several domestic appliances, in the kitchen for example, when the loss of a single domestic appliance proves to be comparatively low, it is all the same desirable to protect this electrical appliance from total damage, as far as possible. But because the device disclosed in DE 38 09 754 A1 comes into play only when the electrics are already partially destroyed, substantial damage has already occurred in this appliance.

The object of the present invention is therefore to provide a fire protection and fire extinguishing device for an aquiferous domestic appliance, which, right at the outset of a malfunction which could potentially result in the domestic appliance catching fire, initiates measures to protect the domestic appliance from further damage, prevent the danger of fire and extinguish any existing fire.

According to the present invention this task is solved by a fire protection and fire extinguishing device having the features specified in claim 1. Advantageous configurations of the present invention are specified in the sub-claims.

With the fire protection and fire extinguishing device for aquiferous domestic appliances according to the present invention the spread of a smouldering fire, caused by electrical failures, is prevented, since gases resulting from smouldering are detected by the gas sensor, and a signal is generated when a certain quantity of control gas, for example carbon monoxide (CO) and/or chlorine (CI), is present inside the domestic appliance, which results in disconnection of the electricity supply inside the domestic appliance, as well as activation of a water sprinkler system for extinguishing fire inside the domestic appliance.

With the fire protection and fire extinguishing device for aquiferous domestic appliances according to the present invention it eventuates that smouldering, an open fire or smoke is recognised and the aquiferous domestic appliance is cut off promptly from the mains supply, and the electric ignition energy for the fire or the smouldering is stopped. If a fire does break out the water sprinkler system is activated to extinguish fires by means of a spray mist, for example.

When the fire protection and fire extinguishing device for domestic appliances according to the present invention is used the onset of smoke, attributable essentially to polyethylene (PE), polypropylene (PP), polyamide (PA), polyvinyl chloride (PVC) or polystyrol (PS), is detected early enough by the gas sensor in a first safety step, since carbon monoxide (CO) and/or chlorine (Cl) is released when these synthetic substances combust. When the mains is disconnected leak currents can be prevented from skipping from or to adjacent electrical appliances, which are situated in the same current circuit. In a second step the water sprinkler system is activated and generates a spray mist or the like, for example, inside the aquiferous domestic appliance. To prevent likewise unwanted damage caused by water, which might occur as a result of the spray mist, the aquiferous domestic appliance has a base pan which registers any rise in the water trapped in the base pan by means of a float element and then blocks the water supply to the water sprinkler system as soon as a preset level is reached. The present invention provides a fire protection and fire extinguishing device for domestic appliances, which, at the outset of a malfunction which could potentially result in the domestic appliance catching fire, initiates measures both to protect the domestic appliance from further damage, and prevent the danger of fire, as well as extinguish an existing fire.

Advantageously the gas sensor is arranged in the floor region and/or a door of the domestic appliance.

Figure 2:
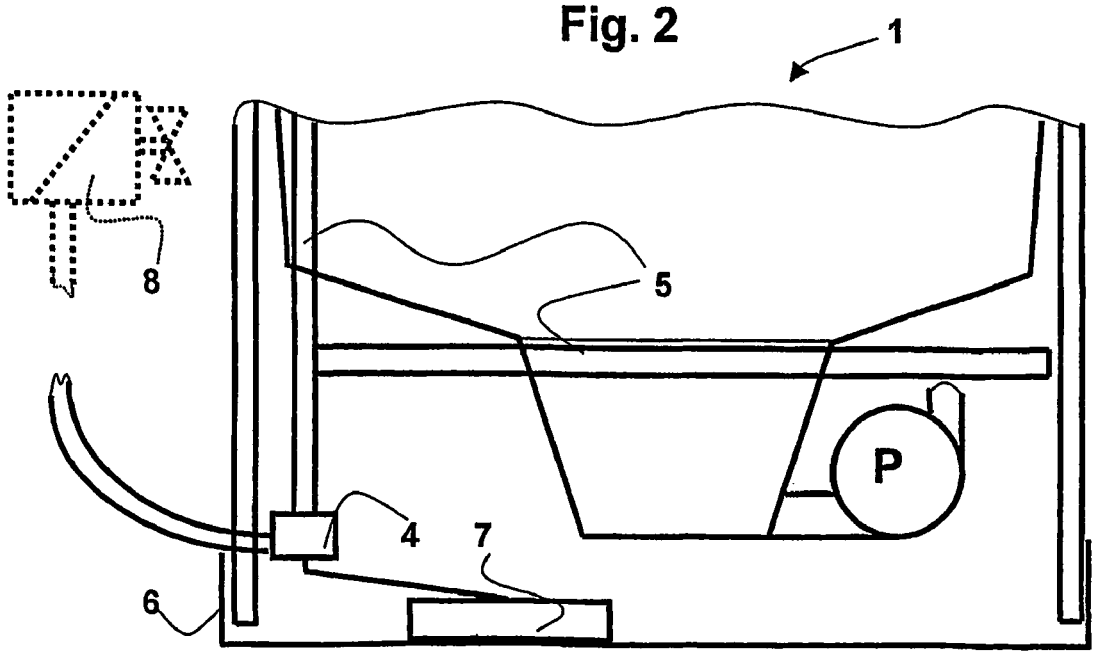

The fire protection and fire extinguishing device according to the present invention will be explained hereinbelow in greater detail with reference to preferred embodiments, in which:

FIG. 1 shows a circuit plan of a fire protection and extinguishing device according to the present invention, and FIG. 2 shows a schematic diagram of an aquiferous domestic appliance with the fire protection and fire extinguishing device according to the present invention as in FIG. 1.

The fire protection and fire extinguishing device for aquiferous domestic appliances according to the present invention will be explained hereinbelow in terms of an embodiment of a dishwashing machine 1.

Arranged in the floor space of the dishwashing machine 1 in the above described embodiment is a gas sensor 2, assigned to which is a gas sensor circuit, and which is connected by electric lines to a relay 3, in the illustrated embodiment a bistable relay 3, so that when a signal is emitted from the gas sensor 2 the mains current circuit is interrupted and the dishwashing machine 1 is then without surrent. The relay 3 is activated by response from the gas sensor 2, so that all components of the domestic appliance 1 are cut off from the mains supply. At the same time a reversing valve 4 is actuated, so that water can flow into a loop line 5. The loop line 5 is arranged advantageously in the interior of the domestic appliance such that all combustible material can be wetted by a generated spray mist. The loop line 5 is designed effectively as an inflammable line and is guided to all endangered components, whereby nozzles are provided in the loop line 5 at the critical sites, through which water or a water mist can escape. Water is sprayed through the loop line 5 until such time as a preset switch level is reached in the base pan 6 (see FIG. 2) and a float 7 positioned therein blocks off a shut-off valve 8, which regulates the water supply to the domestic appliance, (indicated in FIG. 2 by dotted lines). In a particularly advantgeous way units such a pumps P, heaters or heat exchangers etc. are arranged above the preset switch level in order to keep possible water damage to the possible minimum.

The invention provides a fire protection and fire extinguishing device for an aquiferous domestic appliance 1, which carries out measures at the outset of a malfunction with potential fire consequences for the domestic appliance 1, in order both to protect the domestic appliance 2 from further damage, and to prevent the danger of fire, as well as extinguish an existing fire.

The invention claimed is:

1. A fire protection and fire extinguishing device for an aquiferous domestic appliance coupled to an electrical supply, the aquiferous domestic appliance having a water supply arrangement for supplying water to the domestic appliance such that the domestic appliance can perform an aquiferous operation on items being handled by the domestic appliance, the fire protection and fire extinguishing device comprising:

means for monitoring the atmosphere within the domestic appliance, detecting gasses resulting from smoldering electrical components prior to the onset of fire, and generating a signal upon detecting gasses resulting from smoldering electrical components;

means for disconnecting main electrical power to the appliance in operational communication with said monitoring means and operational to disconnect electrical power to the appliance responsive to a signal from said monitoring means;

at least one water sprinkler system activated by said means for monitoring the atmosphere for providing a spray mist to said appliance when said electrical supply is switched off from said appliance to extinguish a fire, said at least one water sprinkler system being connected to the water supply arrangement of the domestic appliance for receiving water therefrom and said means for monitoring the atmosphere being located in a door of said domestic appliance; and a base pan for capturing said water from said spray mist and a float element disposed within the base pan in a configuration wherein the float element rises with rising water and is in operational communication with a water input shut-off valve for closing said water input shut-off valve when a preset float water level is reached in said base pan, thereby forestalling water from escaping said base pan.

2. The fire protection and fire extinguishing device according to claim 1, wherein the appliance comprises a plurality of conductors and an all-pole disconnection operatively connected to the plurality of conductors and said means for monitoring the atmosphere is operatively connected to the all-pole disconnection so as to effect switching off of electrical supply through the plurality of conductors when said sensor senses gas and causes said electrical supply to be switched off.

3. A fire protection and fire extinguishing device for an aquiferous domestic appliance coupled to an electrical supply, the aquiferous domestic appliance having a water supply arrangement for supplying water to the domestic appliance such that the domestic appliance can perform an aquiferous operation on items being handled by the domestic appliance, the fire protection and fire extinguishing device comprising:

means for monitoring the atmosphere within the domestic appliance, detecting gasses resulting from smoldering electrical components, and generating a signal upon detecting gasses resulting from smoldering electrical components prior to the onset of fire;

means for disconnecting main electrical power to the appliance in operational communication with said monitoring means and operational to disconnect electrical power to the appliance responsive to a signal from said monitoring means;

at least one water sprinkler system activated by said means for monitoring the atmosphere for providing a spray mist to said appliance when said electrical supply is switched off from said appliance to extinguish a fire, said at least one water sprinkler system being connected to the water supply arrangement of the domestic appliance for receiving water therefrom and said means for monitoring the atmosphere being located in a door of said domestic appliance; and a base pan for capturing said water from said spray mist and a float element disposed within the base pan in a configuration wherein the float element rises with rising water and is in operational communication with a water input shut-off valve for closing said water input shut-off valve when a preset float water level is reached in said base pan, thereby forestalling water from escaping said base pan.

4. The fire protection and fire extinguishing device according to claim 3, including said water sprinkler system includes a loop line arranged inside of said domestic appliance to provide a spray mist to critical components of said domestic appliance.

* * * * *